US012628876B2

(12) United States Patent
Yamaguchi

(10) Patent No.: US 12,628,876 B2
(45) Date of Patent: May 19, 2026

(54) AEROSOL GENERATION DEVICE AND METHOD FOR CONTROLLING SUCH AN AEROSOL GENERATION DEVICE

(71) Applicant: JT International S.A., Geneva (CH)

(72) Inventor: Akira Yamaguchi, Geneva (CH)

(73) Assignee: JT International S.A., Geneva (CH)

( * ) Notice: Subject to any disclaimer, the term of this patent is extended or adjusted under 35 U.S.C. 154(b) by 447 days.

(21) Appl. No.: 18/283,357

(22) PCT Filed: Mar. 22, 2022

(86) PCT No.: PCT/EP2022/057399
§ 371 (c)(1),
(2) Date: Sep. 21, 2023

(87) PCT Pub. No.: WO2022/200299
PCT Pub. Date: Sep. 29, 2022

(65) Prior Publication Data

US 2024/0090584 A1 Mar. 21, 2024

(30) Foreign Application Priority Data

Mar. 22, 2021 (EP) ..... 21164024

(51) Int. Cl.
*A24F 40/51* (2020.01)
*A24F 40/46* (2020.01)
*A24F 40/53* (2020.01)

(52) U.S. Cl.
CPC ..... *A24F 40/51* (2020.01); *A24F 40/46* (2020.01); *A24F 40/53* (2020.01)

(58) Field of Classification Search
CPC ..... A24F 40/51; A61M 11/042
See application file for complete search history.

(56) References Cited

U.S. PATENT DOCUMENTS

2021/0007401 A1* 1/2021 Moloney et al. ..... A24F 40/57

FOREIGN PATENT DOCUMENTS

| | | | |
|---|---|---|---|
| WO | 9527411 | A1 | 10/1995 |
| WO | 2015082560 | A1 | 6/2015 |
| WO | 2019224310 | A1 | 11/2019 |
| WO | 2020193196 | A1 | 10/2020 |
| WO | 2020201295 | A1 | 10/2020 |

OTHER PUBLICATIONS

International Search Report for PCT/EP2022/057399 mailed Jul. 11, 2022. 5 pages.

* cited by examiner

*Primary Examiner* — Michael H. Wilson
*Assistant Examiner* — Ronnie Kirby Jordan
(74) *Attorney, Agent, or Firm* — Lerner David LLP

(57) ABSTRACT

An aerosol generation device designed to operate with a consumable article includes a socket for receiving the consumable article; a heater configured to heat the consumable article when it is received in the socket; first and second sensors each configured to detect the consumable article inside a respective first and second portion of the socket and generate a respective first and second sensor signal; and a controller for controlling the operation of the heater according to both sensor signals. Each sensor includes a respective roller configured to rotate when the consumable article is being received in the corresponding portion of the socket or extracted from such portion.

14 Claims, 9 Drawing Sheets

39

| Second sensor signal (S24B) / First sensor signal (S24A) | Positive (+) | Negative (-) | Null (0) |
|---|---|---|---|
| Positive (+) | Activation | – | No action |
| Negative (-) | – | No action | No action |
| Null (0) | – | – | No action or deactivation depending on previous state |

FIG.8

139

| Second sensor signal (S24B) / First sensor signal (S24A) | Positive (+) | Negative (-) | Null (0) |
|---|---|---|---|
| Positive (+) | Activation | – | No action |
| Negative (-) | – | No action | Deactivation |
| Null (0) | – | – | No action |

FIG.9

AEROSOL GENERATION DEVICE AND METHOD FOR CONTROLLING SUCH AN AEROSOL GENERATION DEVICE

CROSS-REFERENCE TO RELATED APPLICATIONS

The present application is a national phase entry under 35 U.S.C. § 371 of International Application No. PCT/EP2022/057399, filed Mar. 22, 2022, published in English, which claims priority to European Application No. 21164024.8 filed Mar. 22, 2021, the disclosures of which are incorporated herein by reference.

FIELD OF THE INVENTION

The invention concerns an aerosol generation device.

The invention also concerns a controlling method for controlling such an aerosol generation device.

BACKGROUND OF THE INVENTION

Some aerosol generation devices known in the art comprise a part suitable for receiving a consumable article, such as a tobacco article, in particular a cigarette. In this case, these devices are generally adapted to heat the consumable article without burning it and thus, are usually called "heat not-burn" devices. These devices generally comprise a heater for heating the consumable article. Thus, the aerosol generated from the consumable article is generated by heating the consumable article and delivered to the user through a mouth portion of the consumable article.

Those known devices may be adapted to generate a variable amount of aerosol (as opposed to a metered dose of aerosol), e.g. by activating a heater system for a variable period of time, which can be controlled by a trigger. The trigger may consist of a vaping button adapted to be actuated by the user or a pressure sensor activating the heater upon detection an airflow inside the device.

However, the use of such a vaping button or pressure sensor for activating and/or deactivating the heater may result in a complicated control of the operation of the heater for some users and/or an excessive power consumption by the heater due to an improper use of the vaping button or pressure sensor.

SUMMARY OF THE INVENTION

One aim of the invention is to provide an aerosol generation device designed to operate with a consumable article easier to control by a user.

For this purpose, the invention relates to an aerosol generation device designed to operate with a consumable article, comprising:

- a socket configured to receive the consumable article;
- a heater arranged at least partially adjacent to the socket and configured to heat the consumable article when it is received in the socket;
- at least a first sensor and a second sensor, each of the first sensor and the second sensor being configured to detect the consumable article inside at least a first portion of the socket, respectively a second portion of the socket and generate a first sensor signal, respectively a second sensor signal;
- a controller configured to control the operation of the heater according to both sensor signals,

- wherein each sensor comprises a roller movable in rotation when the consumable article is being received in the corresponding portion of the socket or extracted from this portion.

Thanks to these features of the invention, it is possible to control the operation of the heater according to the position of the consumable article inside the socket. The position of the consumable article inside the socket can thus determine the mode of operation of the heater. Moreover, using two sensors configured to detect the consumable article inside two different portions of the socket, it is possible to control the operation of the heater based on the detection or non-detection of the consumable article inside a specific portion of the socket. Controlling the operation of the device is thus more intuitive and easier for a user since the user can visualize the position of the consumable article inside the socket as compared to the existing solutions comprising a vaping button.

Additionally, the use of sensors comprising rollers movable in rotation enables to obtain a simple structure of the aerosol generation device. Thus, using rollers enables to limit the manufacturing costs of the aerosol generation device while obtaining an accurate control of the heater. Moreover, rollers enable to generate control signals which can be easily processed to control the operation of the heater.

According to some embodiments, the socket extends along a socket axis, the second sensor and the first sensor being arranged successively along to the socket axis.

Thanks to these features, control of the operation of the heater depends on an insertion position or extraction position of the consumable article along the socket axis.

According to some embodiments, the socket is delimited by an internal wall, each sensor being arranged in an aperture formed on the internal wall and protruding from this aperture.

According to some embodiments, each sensor is configured to provide the direction of rotation of the corresponding roller.

Thanks to these features, control of the operation of the heater is based on an insertion direction or on an extraction direction of the consumable article.

According to some embodiments, the controller is configured to control the operation of the heater according to a control logic depending on each of the first sensor signal and the second sensor signal.

Thanks to these features, it is possible to predetermine activation and deactivation moments of the heater based on the first sensor signal and the second sensor signal.

According to some embodiments, each of the first sensor signal and the second sensor signal is positive when the direction of rotation of the corresponding roller corresponds to an insertion direction of the consumable article in the corresponding portion of the socket, negative when the direction of rotation of the corresponding roller corresponds to an extraction direction of the consumable article from the corresponding portion of the socket, and null otherwise.

Thanks to these features, the first sensor signal and the second sensor signal are representative of the insertion direction inside the socket or the extraction direction from the socket of the consumable article. Control of the operation of the heater thus depends on the direction of the movement of the consumable article among the insertion direction and the extraction direction of the consumable article.

According to some embodiments, the control logic includes activating the operation of the heater if each of the first sensor signal and the second sensor signal is positive.

Thanks to these features, the heater is activated only when the consumable article is being inserted and is already inside both first and second portions of the heater. Moreover, when the second sensor and the first sensor are arranged successively along the socket axis, the heater is activated when the consumable article is sufficiently inserted inside the socket. This prevents an untimely activation of the heater. These features also prevent unnecessary power consumption when, after having partly inserted the consumable article inside the socket, the user finally decides not to vape.

According to some embodiments, the control logic includes maintaining current state of the heater if the first sensor signal is positive and the second signal is null, or the first sensor signal is negative and the second sensor signal is negative.

When the first sensor signal is positive and the second sensor signal is null, the consumable article is being inserted and is detected inside the first portion of the socket only. In this situation, the control logic enables to avoid activation of the heater when the consumable article is not detected inside the second portion of the socket. In this configuration of the control logic, no action is taken by the controller. Untimely activation of the heater and waste of a power supply supplying the heater can thus be avoided.

When the first sensor signal is negative and the second signal is negative, the consumable article is being extracted and detected inside both first and second portions of the socket. In this situation, the control logic including maintaining the current state of the heater enables, for example, to maintain the activated state of the heater while the consumable article is being extracted. In this configuration of the control logic, no action is taken by the controller. Thanks to these features, untimely deactivation of the heater can be avoided.

According to some embodiments, the control logic includes maintaining current state of the heater if each of the first sensor signal and the second sensor signal is null after being positive.

Thanks to these features, activation of the heater is maintained when the consumable article is detected inside both first and second portions of the socket. In this configuration of the control logic, no action is taken by the controller.

According to some embodiments, the control logic includes deactivating the operation of the heater if each of the first sensor signal and the second sensor signal is null after being negative.

Thanks to these features, the heater is deactivated when the consumable article is extracted from both first and second portions of the socket. Moreover, when the second sensor and the first sensor are arranged successively along the socket axis, the heater is thus deactivated when the consumable article is sufficiently extracted from the socket. These features make it possible to ensure that the user is willing to stop vaping. This prevents an untimely deactivation of the heater while the user moves unintentionally the consumable article in an extraction direction while willing to continue vaping. These features thus also enable to reduce power consumption of the heater due to untimely deactivation and activation of the heater.

According to some embodiments, the control logic includes maintaining current state of the heater if the first sensor signal is negative and the second signal is null.

Thanks to these features, the current state of the heater is maintained when the consumable article is being extracted from the socket and is detected inside the first portion of the socket only. Thus, it is possible to maintain the activated state of the heater when the consumable article is being extracted from the socket but still detected inside the first portion of the socket.

According to some embodiments, the control logic includes deactivating the operation of the heater if the first sensor signal is negative and the second sensor signal is null.

In other words, the operation of the heater is deactivated when the consumable article is being extracted from the socket and is detected inside the first portion of the socket only.

According to some embodiments, the control logic includes maintaining current state of the heater if each of the first sensor signal and the second sensor signal is null.

In other words, when each roller of the first and second sensors does not rotate (i.e. are stationary), no action is taken by the controller.

The invention also concerns a controlling method for controlling an aerosol generation device as defined above, comprising controlling the operation of the heater according to both sensor signals.

BRIEF DESCRIPTION OF THE DRAWINGS

The invention and its advantages will be better understood upon reading the following description, which is given solely by way of non-limiting example and which is made with reference to the appended drawings, in which:

FIG. 8 is a table showing an example of a control logic for controlling the operation of a heater of the aerosol generation device of FIG. 1; and FIG. 9 is a table showing another example of a control logic for controlling the operation of a heater of the aerosol generation device of FIG. 1.

DETAILED DESCRIPTION OF THE INVENTION

Figure 1:
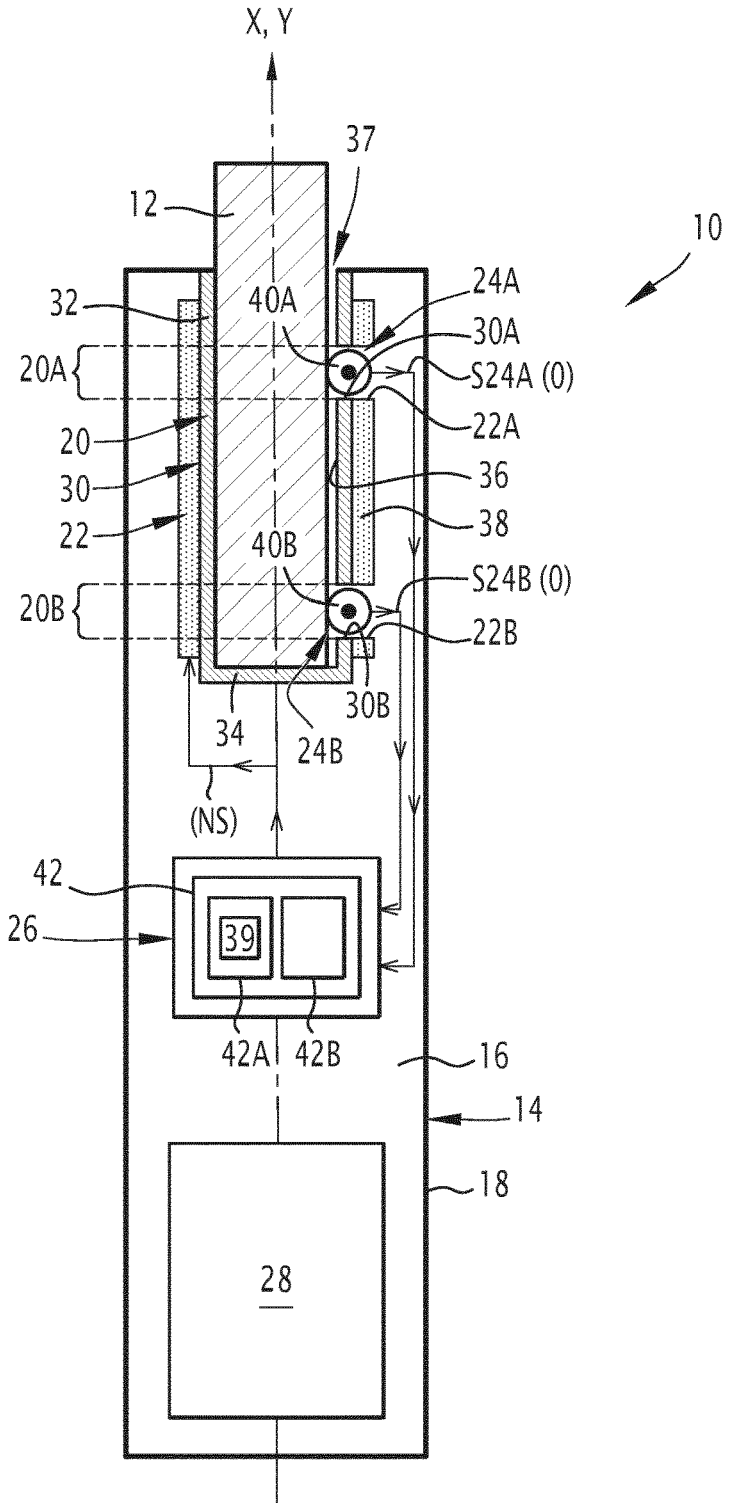
FIG. 1 is a schematic cross-sectional view of an aerosol generation device with a consumable article inserted inside the device.

Before describing the invention, it is to be understood that it is not limited to the details of construction set forth in the following description. It will be apparent to those skilled in the art having the benefit of the present disclosure that the invention is capable of other embodiments and of being practiced or being carried out in various ways.

As used herein, the term "aerosol generation device" or "device" may include a vaping device configured to deliver aerosol to a user generated from at least a consumable article received into the device. The device may be portable. "Portable" may refer to the device being for use when held by a user. The device may be adapted to generate an amount of aerosol by activating a heater configured to heat the consumable article when the consumable article is received in a socket of the aerosol generation device.

As used herein, the term "controller" refers to a component of the aerosol generation device, configured to control the operation of the heater. The operation of the heater may include activating, deactivating and maintaining the current state of the heater. The controller may be configured to send a signal to the heater for controlling the operation of the heater. The controller may also include a temperature regulation control to drive the temperature of the heater and/or the heating of a vaporizable material and/or the heating of the tobacco article to a specified target temperature and thereafter to maintain the temperature at the target temperature that enables efficient generation of aerosol.

As used herein, the term "consumable article" may refer to a consumable article and may be a capsule, a stick or a ready-made cigarette containing a vaporizable material.

As used herein, the term "vaporizable material" or "precursor" or "aerosol forming substance" or "substance" is used to designate any material that is vaporizable in air to form aerosol. Vaporization is generally obtained by a temperature increase up to the boiling point of the vaporization material, such as at a temperature less than 400° C., preferably up to 350° C. The vaporizable material may, for example, comprise or consist of an aerosol-generating liquid, gel, wax, foam or the like, an aerosol-generating solid that may be in the form of a rod, which contains processed tobacco material, a crimped sheet or oriented strips of reconstituted tobacco (RTB), or any combination of these. The vaporizable material may comprise one or more of: nicotine, caffeine or other active components. The active component may be carried with a carrier, which may be a liquid. The carrier may include propylene glycol or glycerin. A flavoring may also be present. The flavoring may include Ethylvanillin (vanilla), menthol, Isoamyl acetate (banana oil) or similar.

As used herein, the term "aerosol" may include a suspension of one or more of: solid particles; liquid droplets; gas. Said suspension may be in a gas including air. Aerosol herein may generally refer to/include a vapor. Aerosol may be formed by the consumable article and may comprise one or several components of it. Aerosol may be inhaled by a user of the aerosol generation device through a mouth portion of the consumable article.

First Embodiment of the Invention

An aerosol generation device 10 according to a first embodiment of the invention is shown on FIGS. 1 to 7. The aerosol generation device 10 is designed to operate with a consumable article 12.

In the particular example shown on FIGS. 1 to 7, the consumable article 12 is a stick having a cylindrical shape having a circular or elliptical cross-section. The stick may have a length comprised between 69 mm and 100 mm and a diameter comprised between 5 mm and 8 mm. As a variant, the consumable article 12 may have a different shape. For example, the stick is a ready-made cigarette. According to another example, the stick presents a flat-shape stick having a rectangular cross-section. The consumable article 12 may have a filter portion designed to be in contact with the user's mouth/lips and a storage portion designed to store a vaporizable material. The storage portion is designed to be heated by the heater of the device 10 as it will be explained below in further detail. The heating temperature of the storage portion is for example less than 400° C. and is preferably comprised between 200° C. and 390° C. Advantageously, the heating temperature is substantially equal to 350° C. More generally, the heating temperature is chosen to not burn but only heat the vaporizable material.

The aerosol generation device 10 is described in the following in reference to FIG. 1.

The aerosol generation device 10 extends along an axis X called hereinafter "device axis X". In the following description, the term "length" refers to a dimension of an element of the aerosol generation measured along the device axis X.

The aerosol generation device 10 comprises an outside casing 14 and internal components arranged in the outside casing 14. The outside casing 14 delimits an internal volume 16 and comprises a side surface 18 extending along the device axis X. The side surface 18 may present for example a smooth surface.

The internal components of the aerosol generation device 10 comprise a socket 20 configured to receive the consumable article 12 and a heater 22 configured to heat the consumable article 12 when it is received in the socket 20. The internal components further comprise at least a first sensor 24A and a second sensor 24B configured to detect the consumable article 12 inside at least a first portion 20A of the socket 20, respectively a second portion 20B of the socket 20, a controller 26 configured to control the operation of the heater 22 and a battery 28 for powering the device 10.

The aerosol generation device 10 may further comprise other components performing different functionalities of the device. These other components are known per se and will be not explained in further detail below.

The battery 28 is for example a known battery designed to be charged using the power supply furnished by an external charger and to provide a direct current of a predetermined voltage. The battery 28 is for example configured to power the heater 22 and the controller 26.

The socket 20 is configured to receive the consumable article 12. The socket 20 extends along a socket axis. In the example shown in FIG. 1, the socket axis coincides with the device axis X. The socket axis is referred hereinafter as "socket axis Y". The socket 20 is delimited by an internal wall 30. The internal wall 30 comprises a lateral portion 32 and a bottom portion 34. The lateral portion 32 may have an annular shape. The bottom portion 34 may be substantially perpendicular to the socket axis Y. The internal wall 30 and the bottom portion 34 define a receiving hole 36. At one end of the socket 20 along the socket axis Y, the receiving hole 36 opens at the exterior of the aerosol generation device 10 by an insertion opening 37 and at the other extremity of the socket 20 along the socket axis Y, the receiving hole 36 is closed by the bottom portion 34. For example, the socket axis Y is oriented from the bottom portion 34 of the socket 20 to the insertion opening 37. The receiving hole 36 may have a shape adapted to the shape of the consumable article 12. The length of the receiving hole 36 is, for example, smaller than the length of the consumable article 12 such that a mouth portion of the consumable article 12 protrudes from the receiving hole 36 when the consumable article 12 is inserted into the socket 20 as shown in FIG. 1.

For each of the first sensor 24A and the second sensor 24B, the internal wall 30 of the socket 20 comprises an aperture referred hereinafter as "first socket aperture 30A" and "second socket aperture 30B" respectively. Advantageously, the first socket aperture 30A and the second socket aperture 30B are formed in the lateral portion 32 of the internal wall 30. Each socket aperture 30A, 30B may be a through-aperture. The first socket aperture 30A and the second socket aperture 30B are at a distance from each other along the socket axis Y. According to the example shown on FIG. 1, the first socket aperture 30A is formed in a first half of the socket 20 and the second socket aperture 30B is formed in the second half of the socket 20. The first half of the socket 20 and the second half of the socket 20 are defined respectively on one side and on the other side of a median plane of the socket 20. The median plane of the socket 20 is substantially perpendicular to the socket axis Y and cuts the socket 20 in two substantially parts having substantially the same length. In the example shown on FIG. 1, the first socket aperture 30A is above the second socket aperture 30B along the socket axis Y.

As shown on FIG. 1, the heater 22 is at least partially adjacent to the socket 20. In particular, the heater 22 surrounds the socket 20. More precisely, the heater 22 is at least partially adjacent to the internal wall 30 of the socket 20. The heater 22 may be made of at least one heating portion. According to an example, the heater 22 may comprise a unique heating portion. According to a variant, the heater 22 may comprise a plurality of heating portions. In this case, the plurality of heating portions may be arranged successively along the receiving hole 36, i.e. along the socket axis Y. The or each heating portion may have an annular shape. In a cross section plane perpendicular to the socket axis Y, the or each heating portion may have a shape adapted to the shape of the internal wall 30 and in particular to the shape of the lateral portion 32 of the internal wall 30. As an example, said shape of the or each heating portion is circular. The or each heating portion may be made of a heating film suitable for heat transfer. The heating film may be made in a flexible material. According to a variant, the or each heating portion may be made of a metal or any other material suitable for heat transfer.

According to other embodiments, the heater 22 may be at least partially arranged in the internal wall 30 of the socket 20 and notably in the lateral portion 32 and/or the bottom portion 34 of this wall 30.

According to a particular example of the invention, the heater 22 is a cup-shaped heater.

In the example of FIG. 1, for each of the first sensor 24A and the second sensor 24B, the heater 22 defines an opening referred hereinafter as "first heater opening 22A" and "second heater opening 22B". Each heater opening 22A, 22B may be a through-opening. The first heater opening 22A and the second heater opening 22B faces respectively with the first socket aperture 30A and the second socket aperture 30B. Each of the first sensor 24A and the second sensor 24B protrudes from the corresponding heater opening 22A, 22B. In the specific example shown on FIG. 1, the heater 22 has a unique heating portion 38.

The heater 22 is configured to heat the consumable article 12 at a heating temperature.

The first sensor 24A, respectively the second sensor 24B, is configured to detect the consumable article 12 inside the first portion 20A of the socket 20, respectively the second portion 20B of the socket 20 and to generate a first sensor signal S24A, respectively a second sensor signal S24B. According to the example of the invention, the first portion 20A of the socket 20 corresponds to the part of the receiving hole 36 arranged in front of the first socket aperture 30A and the second portion 20B of the socket 20 corresponds to the part of the receiving hole 36 arranged in front of the second socket aperture 30B. In the specific example shown on FIG. 1, the aerosol generation device 10 comprises two sensors. However, in a general case, the number of sensors can be greater than two. In this case, each sensor is configured to detect the consumable article 12 inside a respective portion of the socket 20.

Advantageously, the second sensor 24B and the first sensor 24A are arranged successively along the socket axis Y. In particular, the first sensor 24A is arranged closer to the insertion opening 37 of the receiving hole 36 than the second sensor 24B. Each of the first sensor 24A and the second sensor 24B protrudes from the corresponding socket aperture 30A, 30B. In other words, the first sensor 24A is above the second sensor 24B along the socket axis Y. Thus, when the consumable article 12 is inserted inside the socket 20, the first sensor 24A is configured to detect first the consumable article 12 and the second sensor 24B is configured to detect the consumable article 12 after the first sensor 24A. Each of the first sensor 24A and the second sensor 24B is arranged in the corresponding socket aperture 30A, 30B and protrudes from this socket aperture 30A, 30B. Moreover, each of the first sensor 24A and the second sensor 24B is arranged in the corresponding heater opening 22A, 22B and protrudes from this heater opening 22A, 22B. The first sensor 24A crosses the first half of the socket 20 and the second sensor 24B crosses the second half of the socket 20.

Each of the first sensor 24A and the second sensor 24B comprises a roller 40A, 40B mobile in rotation when the consumable article 12 is being received in the corresponding portion 20A, 20B of the socket 20 or extracted from this portion 20A, 20B. The rollers 40A, 40B will be referred hereinafter as "first roller 40A" and "second roller 40B" respectively. Each roller 40A, 40B is mobile in rotation along a rotation axis perpendicular to the socket axis Y. The first roller 40A and the second roller 40B are arranged in the corresponding socket aperture 30A, 30B such that a contact portion of each of the first roller 40A and the second roller 40B is configured to be in contact with the consumable article 12 while it is being inserted in the socket 20 and extracted from the socket 20. In particular, each of the first roller 40A and the second roller 40B is configured to be rotated by the consumable article 12 while it is being inserted in or extracted from the socket 20.

Each of the first sensor signal S24A and the second sensor signal S24B is configured to provide the direction of rotation of the corresponding roller 40A, 40B. For example, each of the first sensor signal S24A and the second sensor signal S24B may be a voltage signal which can be positive (+) when the direction of rotation of the corresponding roller 40A, 40B corresponds to an insertion direction of the consumable article 12 in the corresponding portion 20A, 20B of the socket 20. The insertion direction is parallel to the socket axis Y. According to the same example, each of the first sensor signal S24A and the second sensor signal S24B may be negative (−) when the direction of rotation of the corresponding roller 40A, 40B corresponds to an extraction direction of the consumable article 12 from the corresponding portion 20A, 20B of the socket 20. The extraction direction is parallel to the socket axis Y. Thus, as shown on FIGS. 1 and 2 and according to the same example, each of the first sensor signal S24A and the second sensor signal S24B is null (0) (i.e. no signal sensor generated) when the corresponding roller 40A, 40B is not moving. As shown on FIGS. 3 and 4, the insertion direction of the consumable article 12 inside the socket 20 corresponds to the trigonometric direction of rotation of the corresponding roller 40A, 40B and, as shown on FIGS. 5 and 6, the extraction direction of the consumable article 12 from the socket 20 corresponds to the anti-trigonometric direction of rotation of the corresponding roller 40A, 40B. According to another embodiment, each of the first sensor signal S24A and the second sensor signal S24B can be equal to a predetermined value when the corresponding roller 40A, 40B is not moving and above or below this value when the corresponding roller 40A, 40B is rotating in an insertion direction or respectively an extraction direction of the consumable article 12. Of course, many other forms and types of signal are possible to encode the rotation direction of the corresponding roller 40A, 40B.

The controller 26 is adapted to control the operation of the heater 22 according to both first sensor signal S24A and second sensor signal S24B generated by the first sensor 24A and the second sensor 24B respectively. More generally, the controller 26 is configured to control the operation of the heater 22 according to a control logic 39 depending on the first sensor signal S24A and the second sensor signal S24B generated by the first sensor 24A and the second sensor 24B respectively. In other words, the control logic 39 depends on the current first sensor signal S24A and the current second sensor signal S24B generated by the corresponding sensors 24A, 24B. The control logic 39 may also depends on the previous first sensor signal and the previous second sensor signal. The previous first sensor signal and the previous second sensor signal correspond respectively to the first sensor signal and the second sensor signal generated just before the current first sensor signal S24A and the current second sensor signal S24B.

The controller 26 is configured to send control signals to the heater 22 to control the heater 22 according to the control logic 39. The control signals are referred hereinafter as "activation control signal AS", "deactivation control signal DS" and "null control signal NS". Advantageously, the null control signal NS corresponds to no signal sent by the controller 26.

As shown on FIG. 1, the controller 26 may comprise a memory 42 which can comprise a non-volatile part 42A configured to store the control logic 39. The control logic 39 may be defined at a service center of the aerosol generation device 10 or during its manufacturing. In some examples, the control logic 39 may be defined or modified by the user using for example an external device like a smartphone. In some embodiments, the memory 42 may further comprise a volatile part 42B (like a RAM) configured to store the first sensor signal S24A and the second sensor signal S24B along the time. In particular, this part 42B of the memory 42 may be adapted to store the direction of rotation of the first sensor 24A and the second sensor 24B along time, that is to say, if the first sensor signal S24A and the second sensor signal S24B are positive (+), negative (−) or null (0). As a particular example, the volatile part 42B of the memory 42 is configured to store the current first sensor signal S24A and the current second sensor signal S24B, at least the previous first sensor signal S24A and at least the previous second sensor signal S24B. Thus, the memory 42 can present a double-buffered memory.

A controlling method for controlling an aerosol generation device 10 according to the first embodiment will now be explained.

The controlling method comprises controlling the operation of the heater 22 according to both first sensor 24A and second sensor 24B.

Initially, it is considered that the consumable article 12 is extracted from the socket 20 and the aerosol generation device 10 is deactivated. When the aerosol generation device 10 is deactivated, the first signal sensor S24A and S24B are null (0). In other words, no signal is generated by the first and the second sensors 24A and 24B. Moreover, when the aerosol generation device 10 is deactivated, the controller 26 sends a null control signal NS to the heater 22 (i.e. no signal is sent by the controller 26 to the heater 22).

Figure 2:
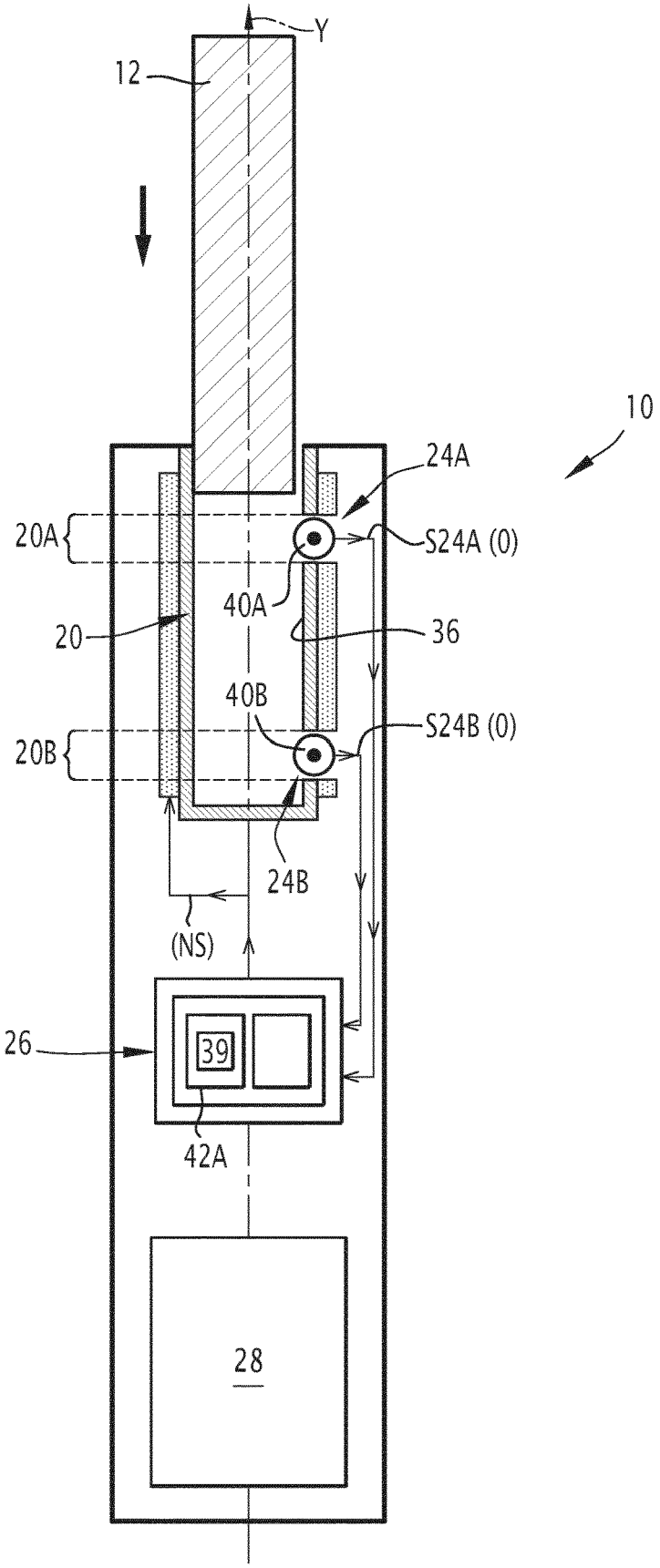
FIGS. 2 to 4 are schematic cross-sectional views of the aerosol generation device of FIG. 1 showing different positions of the consumable article during its insertion inside the socket.
Figure 3:
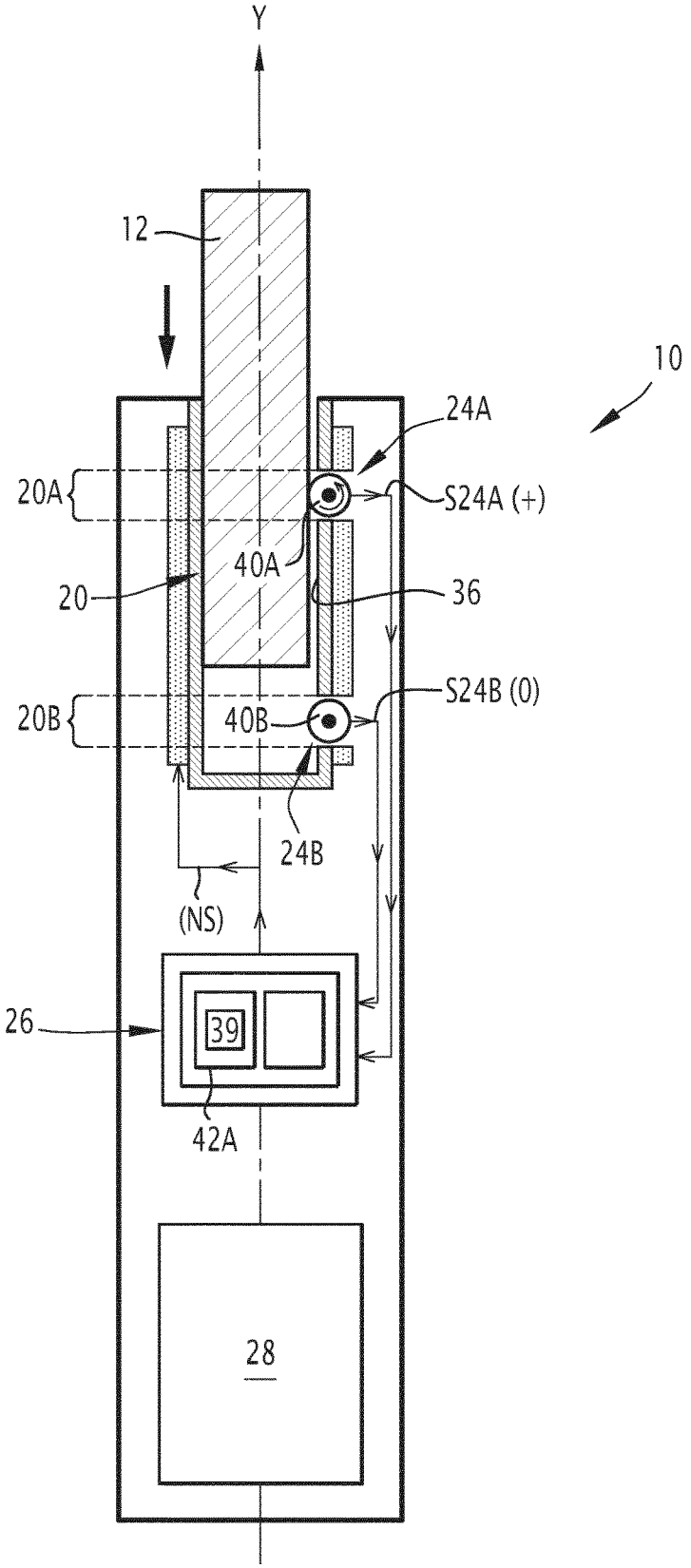
Figure 4:
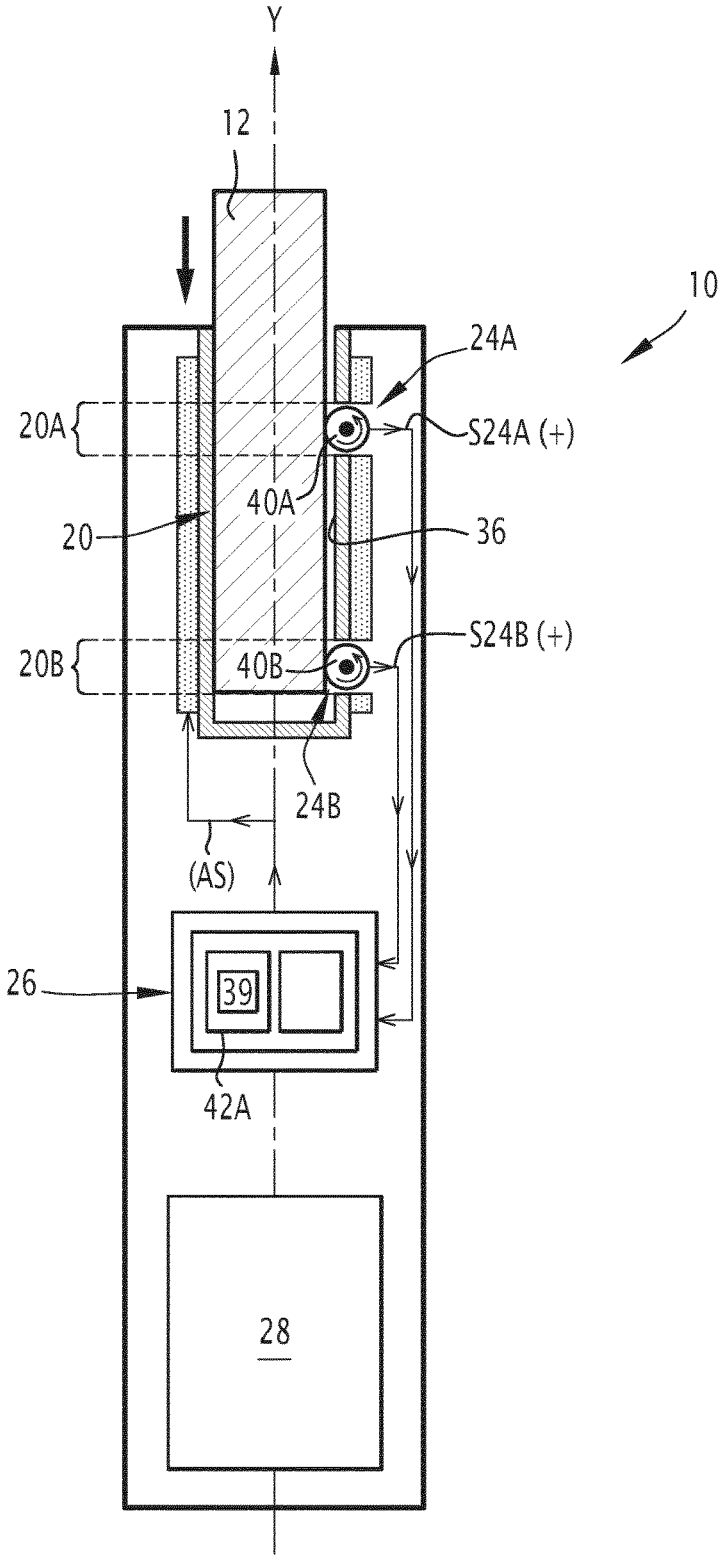

Then, the user starts to insert the consumable article 12 in the socket 20 as shown in FIG. 2. Upon detection of the consumable article 12 in the first portion 20A of the socket 20, the controller 26 operates the heater 22 according to the control logic 39. FIGS. 3 and 4 show the following positions of the consumable article 12 during its insertion.

Particularly, in reference to FIG. 3, the consumable article 12 is being inserted inside the socket 20 and has already passed the first portion 20A of the socket 20. During the insertion, the first roller 40A of the first sensor 24A is mobile in rotation in a direction corresponding to the insertion of the consumable article 12 inside the socket 20 and the second roller 40B is stationary. The first sensor 24A thus detects the consumable article 12 inside the first portion 20A of the socket 20. On the contrary, the second sensor 24B does not detect the consumable article 12 inside the second portion 20B of the socket 20. The first sensor signal S24A generated is positive (+) and the second sensor signal S24B is null (0). The first sensor signal S24A and the second sensor signal S24B generated are sent to the controller 26. In reference to FIG. 8, in this case, the control logic 39 includes maintaining the current state of the heater 22 since the first sensor signal S24A is positive (+) and the second sensor signal S24B is null (0). In the present case, the current state of the heater 22 is deactivation of the heater 22. According to the control logic 39, the controller 26 does not send any control signal (i.e. null control signal NS) to the heater 22 and thus maintains deactivation of the heater 22.

In reference to FIG. 4, the consumable article 12 is being inserted in the socket 20 and has already passed both portions 20A, 20B. During the insertion, both first roller 40A and second roller 40B are mobile in rotation in a direction corresponding to the insertion of the consumable article 12 inside the socket 20. The consumable article 12 is thus detected by the first sensor 24A and the second sensor 24B inside both the first portion 20A and the second portion 20B of the socket 20. The first sensor signal S24A and the second sensor signal S24B generated are both positive (+). The first sensor signal S24A and the second sensor signal S24B generated are sent to the controller 26. In reference to FIG. 8, the control logic 39 includes activating the operation of the heater 22 since each of the first sensor signal S24A and the second sensor signal S24B is positive (+). Thus, according to the control logic 39, the controller 26 sends an activation control signal AS to the heater 22 and thus activates the heater 22.

The user finishes the insertion of the consumable article 12 when it abuts against the bottom portion 34 of the socket 20 as shown on FIG. 1. In this position, the consumable article 12 can be used for vaping.

During vaping, the consumable article 12 may be stationary as shown on FIG. 1. Thus, the first sensor signal S24A and the second sensor signal S24B may be both null (0). In reference to FIG. 8, in this case, the control logic 39 includes maintaining current state of the heater 22 since each of the first sensor signal S24A and the second sensor signal S24B is null (0) after being positive (+). In the present case, the current state of the heater 22 is the activated state of the heater 22. Thus, based on the control logic 39, controller 26 does not send any control signal (i.e. null control signal NS) to the heater 22 and thus maintains activation of the heater 22.

Figure 5:
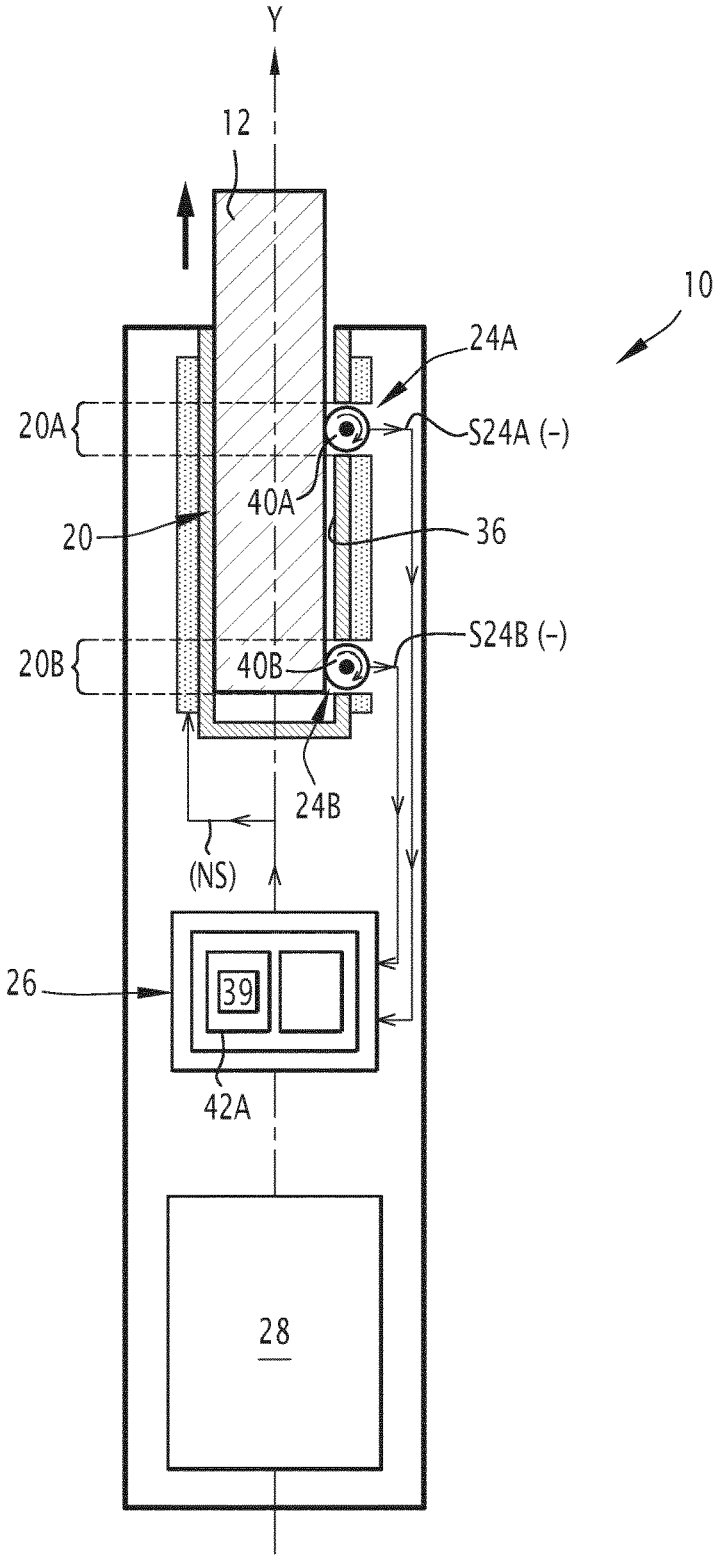
FIGS. 5 to 7 are schematic cross-sectional views of the aerosol generation device of FIG. 1 showing different positions of the consumable article during its extraction from the socket.

When the user begins to extract the consumable article 12 from the socket 20 as shown on FIG. 5, the first roller 40A and the second roller 40B are mobile in rotation in a direction corresponding to the extraction of the consumable article 12 from the socket 20. The consumable article 12 is thus detected by the first sensor 24A and the second sensor 24B inside both the first portion 20A and the second portion 20B of the socket 20. The first sensor signal S24A and the second sensor signal S24B are negative (–). The first sensor signal S24A and the second sensor signal S24B generated are sent to the controller 26. In reference to FIG. 8, the control logic 39 includes maintaining the current state of the heater 22 since the first sensor signal S24A is negative (–) and the second sensor signal S24B is negative (–). In the present case, the current state of the heater 22 is the activated state of the heater 22. Based on the control logic 39, the controller 26 does not send any control signal (i.e. null control signal NS) to the heater 22 and thus maintains activation of the heater 22.

Figure 6:
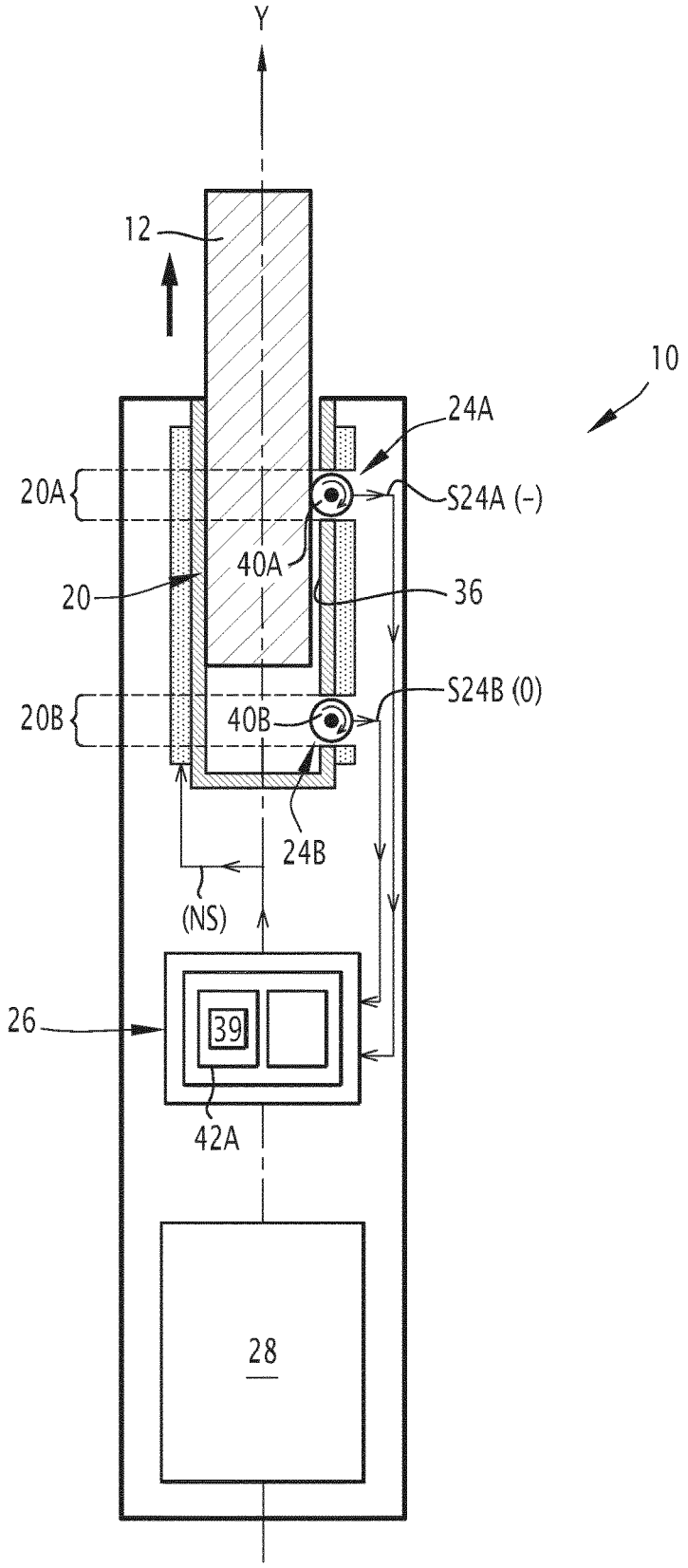
Figure 7:
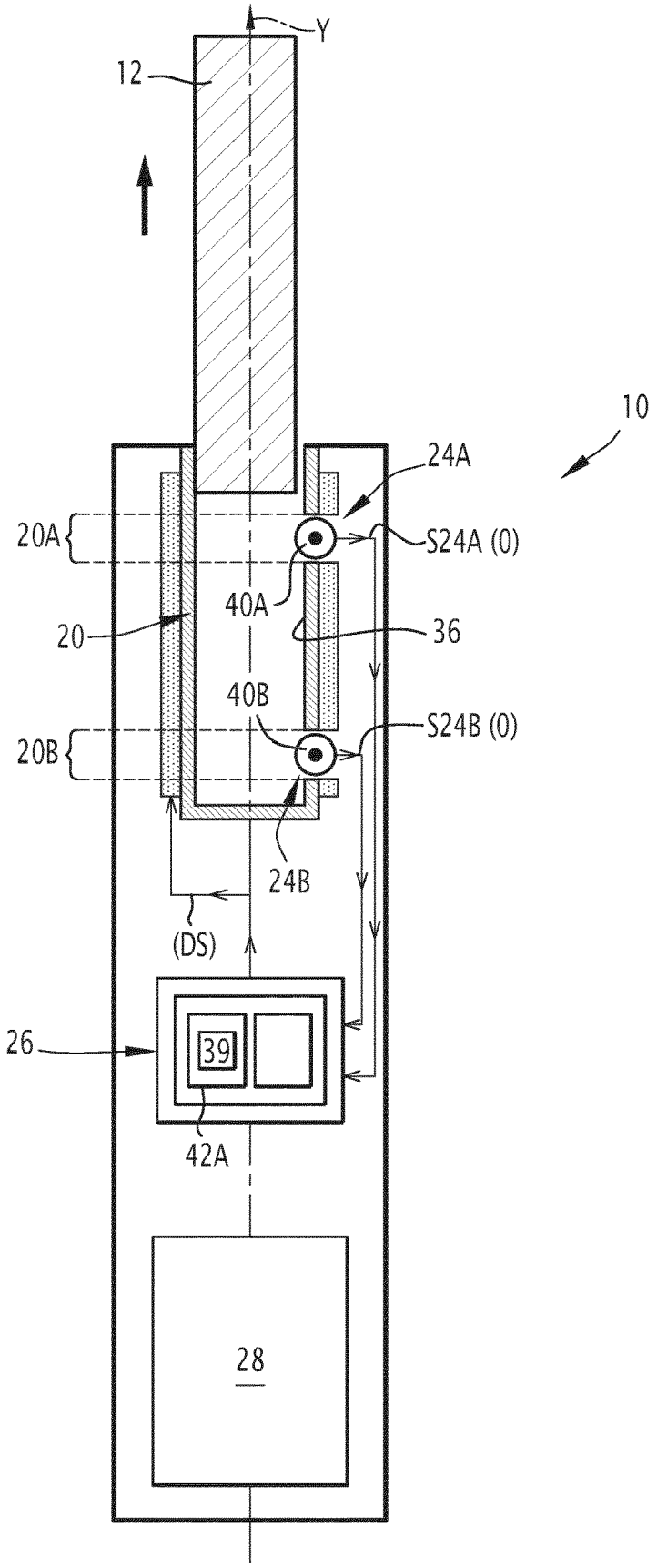

When the user continues to extract the consumable article 12 from the socket 20 as shown on FIG. 6, the first roller 40A is mobile in rotation in a direction corresponding to the extraction direction of the consumable article 12 from the socket 20 and the second roller 40B is stationary. The first sensor 24A thus detects the consumable article 12 inside the first portion 20A of the socket 20. On the contrary, the second sensor 24B does not detect the consumable article 12 inside the second portion 20B of the socket 20. The first sensor signal S24A is null (0) and the second sensor signal S24B is negative (–). The first sensor signal S24A and the second sensor signal S24B generated are sent to the controller 26. In reference to FIG. 8, the control logic 39 includes maintaining the current state of the heater 22 since the first sensor signal S24A is negative (–) and the second sensor signal S24B is null (0). In the present case, the current state of the heater 22 is the activated state of the heater 22. Based on the control logic 39, the controller 26 does not send any control signal (i.e. null control signal NS) to the heater 22 and thus maintains activation of the heater 22.

When the consumable article 12 is extracted from the socket 20 such that the first roller 40A and the second roller 40B are stationary, the first sensor signal S24A and the second sensor signal S24B are null (0) after being negative (–). The first sensor 24A and the second sensor 24B does not detect the consumable article 12 inside the first portion 20A and the second portion 20B of the socket 20. The first sensor signal S24A and the second sensor signal S24B generated are sent to the controller 26. in reference to FIG. 8, the control logic 39 includes deactivating the operation of the heater 22 since each of the first sensor signal S24A and the second sensor signal S24B is null (0) after being negative (–). Based on the control logic 39, the controller 26 send an deactivation control signal DS to the heater 22 and thus deactivates the heater 22.

Second Embodiment of the Invention

An aerosol generation device according to the second embodiment of the invention will be explained in the following.

The aerosol generation device according to the second embodiment comprises the same internal components as the aerosol generation device 10 according to the first embodiment of the invention. These internal components will not be described in further detail below.

The aerosol generation device according to the second embodiment differs from the aerosol generation device 10 of the first embodiment only by the control logic 39 and the memory 42.

Particularly, the controller of the aerosol generation device according to the second embodiment is configured to control the heater of this device according to a control logic 139 which will be explained in more detail in reference to FIG. 9.

The control logic 139 differs from the control logic 39 of the first embodiment in that the control logic 139 includes deactivating the operation of the operation of the heater if the first sensor signal S24A is negative (–) and the second sensor S24B signal is null (0).

Moreover, the control logic 139 according to the second embodiment differs from the control logic 39 of the first embodiment in that the control logic 139 of the second embodiment includes maintaining the current state of the heater if each of the first sensor signal S24A and the second sensor signal S24B is null (0). This configuration of the control logic 139 corresponds to the situation according to which each roller of the first sensor and the second sensor does not rotate.

The memory according to the second embodiment may comprise only the non-volatile part 42A. In other words, the memory according to the second embodiment may not comprise the non-volatile part 42B configured to store the first sensor signal S24A and the second sensor signal S24B along time. Indeed, in the second embodiment of the aerosol generation device, the control logic 139 does not depend on the previous first sensor signal and/or previous second sensor signal.

The controlling method of the aerosol generation device differs from the controlling method of the first embodiment in that when the consumable article is being extracted from the socket and detected inside the first portion of the socket only, the control logic 139 includes deactivating the heater. According to the control logic 139, the controller send a deactivation control signal DS to the heater and thus deactivates the heater.

Moreover, the controlling method of the aerosol generation device differs from the controlling method of the first embodiment in that when the first sensor signal S24A and the second sensor signal S24B are null (0), the control logic 139 includes maintaining the current state of the heater. Thus, if the current state is the activated state of the heater, the controller controls the activation of the heater. On the contrary, if the current state of the heater is the deactivated state of the heater, the controller controls the deactivation of the heater. According to the control logic 139, the controller does not send any control signal (i.e. null control signal NS) to the heater and thus maintains the heater activated or deactivated.

The invention claimed is:

1. An aerosol generation device designed to operate with a consumable article, comprising:

a socket configured to receive the consumable article;

a heater arranged at least partially adjacent to the socket configured to heat the consumable article when the consumable article is received in the socket;

at least a first sensor and a second sensor, each of the first sensor and the second sensor being configured to detect the consumable article inside at least a first portion of the socket and a second portion of the socket, respectively, and to generate a first sensor signal and a second sensor signal, respectively;

a controller configured to control operation of the heater according to both of the first and second sensor signals, wherein each of the first and second sensors comprises a respective roller configured to rotate when the consumable article is being received in the respective first and second portion of the socket or is being extracted from the respective first and second portion of the socket.

2. The aerosol generation device according to claim 1, wherein the socket extends along a socket axis, the second sensor and the first sensor being arranged successively along the socket axis.

3. The aerosol generation device according to claim 1, wherein the socket is delimited by an internal wall, each of the first and second sensors being arranged in a respective aperture positioned along the internal wall, and each of the first and second sensors protruding from the respective aperture.

4. The aerosol generation device according to claim 1, wherein each of the first and second sensors is configured to indicate a direction of rotation of the respective roller.

5. The aerosol generation device according to claim 1, wherein the controller is configured to control the operation of the heater according to a control logic depending on each of the first sensor signal and the second sensor signal.

6. The aerosol generation device according to claim 5, wherein each of the first sensor signal and the second sensor signal is either positive, negative, or null; wherein each of the first and second sensor signals is positive when a direction of rotation of the respective roller corresponds to an insertion direction of the consumable article into the socket; wherein each of the first and second sensor signals is negative when the direction of rotation of the respective roller corresponds to an extraction direction of the consumable article out of the socket; and wherein each of the first and second sensor signals is null when each of the first and second sensor signals is neither negative nor positive.

7. The aerosol generation device according to claim 6, wherein the control logic is configured to activate the operation of the heater if each of the first sensor signal and the second sensor signal is positive.

8. The aerosol generation device according to claim 6, wherein the control logic is configured to maintain a current state of the heater either if the first sensor signal is positive and the second sensor signal is null or if the first sensor signal is negative and the second sensor signal is negative.

9. The aerosol generation device according to claim 6, wherein the control logic is configured to maintain a current state of the heater if each of the first sensor signal and the second sensor signal is null after being positive.

10. The aerosol generation device according to claim 6, wherein the control logic is configured to deactivate the operation of the heater if each of the first sensor signal and the second sensor signal is null after being negative.

11. The aerosol generation device according to claim 6, wherein the control logic is configured to maintain a current state of the heater if the first sensor signal is negative and the second sensor signal is null.

12. The aerosol generation device according to claim 6, wherein the control logic is configured to deactivate the operation of the heater if the first sensor signal is negative and the second sensor signal is null.

13. The aerosol generation device according to claim 12, wherein the control logic is configured to maintain the current state of the heater if each of the first sensor signal and the second sensor signal is null.

14. A method for controlling the aerosol generation device according to claim 1, comprising controlling the operation of the heater based on both of the first and second sensor signals.

* * * * *